US005904971A

United States Patent [19]

Anderson et al.

[11] Patent Number: 5,904,971

[45] **Date of Patent: *May 18, 1999**

[54] HIGH WATER ABSORBENT DOUBLE-RECREPED FIBROUS WEBS

[75] Inventors: Ralph L. Anderson, Boothwyn; Kenneth C. Larson, West Chester, both of Pa.

[73] Assignee: Kimberly-Clark Worldwide, Inc., Neenah, Wis.

[ * ] Notice: This patent is subject to a terminal disclaimer.

[21] Appl. No.: 08/858,140

[22] Filed: May 19, 1997

Related U.S. Application Data

[63] Continuation of application No. 08/482,007, Jun. 7, 1995, Pat. No. 5,674,590.

[51] Int. Cl.[6] ..... B32B 5/12

[52] U.S. Cl. ..... 428/112; 428/105; 428/111; 428/119; 428/152; 428/153; 428/211; 428/218; 428/219; 428/220; 442/408; 442/409; 442/341

[58] Field of Search ..... 428/105, 152, 428/153, 211, 218, 219, 220, 119, 111, 112; 442/408, 9, 341

[56] References Cited

U.S. PATENT DOCUMENTS 4,328,272 5/1982 Maistre ..... 428/105

*Primary Examiner*—Richard Weisberger
*Attorney, Agent, or Firm*—Gregory E. Croft

[57] ABSTRACT

The improved creped non-laminar singular web structure comprising long fibers and short fibers demonstrated by high TWA and Z peeling. Creping causes a certain portion of long synthetic fibers and short fibers to substantially be oriented in a predetermined vertical or Z direction across the thickness of the web structure. In particular, when a stratified preparation containing wet stiff CTMP fibers is used, the vertically oriented CTMP fibers increase the total water absorption (TWA) of the web structure without collapsing. The high TWA print/double-creped paper products manufactured from the above web structure are suitable for heavy wipe and dry uses.

9 Claims, 4 Drawing Sheets

HIGH WATER ABSORBENT DOUBLE-RECREPED FIBROUS WEBS

This application is a continuation of application Ser. No. 08/482,007 entitled "High Water Absorbent Double-Recreped Fibrous Webs" and filed in the U.S. Patent and Trademark Office on Jun. 7, 1995, now U.S. Pat. No. 5,674,590. The entirety of this Application is hereby incorporated by reference.

FIELD OF THE INVENTION

The current invention is generally related to fibrous webs and a method of producing such webs that are characterized by high tensile strength, high water absorbency and low density without sacrificing softness, and more particularly related to fibrous webs that contain certain fibers oriented in a predetermined vertical direction.

BACKGROUND OF THE INVENTION

Disposable paper products have been used as a substitute for conventional cloth wipers and towels. In order for these paper products to gain consumer acceptance, they must closely simulate cloth in both perception and performance. In this regard, consumers should be able to feel that the paper products are at least as soft, strong, stretchable, absorbent, bulky as the cloth products. Softness is highly desirable for any wipers and towels because the consumers find soft paper products more pleasant. Softness also allows the paper product to more readily conform to a surface of an object to be wiped or cleaned. Another related property for gaining consumer acceptance is bulkiness of the paper products. However, strength for utility is also required in the paper products. Among other things, strength may be measured by stretchability of the paper products. Lastly, for certain jobs, absorbency of the paper products is also important.

As prior art shows, some of the above-listed properties of the paper products are somewhat mutually exclusive. In other words, for example, if softness of the paper products is increased, as a trade-off, its strength is usually decreased. This is because conventional paper products were strengthened by increasing interfiber bonds formed by the hydrogen bonding and the increased interfiber bonds are associated with stiffness of the paper products. Another example of the trade-off is that an increased density for strengthening the conventional paper products also generally decreases the capacity to hold liquid due to decreased interstitial space in the fibrous web.

To control the above trade-offs, some attempts had been made in the past. One of the prior art attempts to increase softness in the paper products without sacrificing strength is creping the paper from a drying surface with a doctor blade. Creping disrupts and breaks the above-discussed interfiber bonds as the paper web is fluffed up. As a result of some broken interfiber bonds, the creped paper web is generally softened. Other prior art attempts at reducing stiffness in the paper products include chemical treatments. Instead of the above-discussed reduction of the existing interfiber bonds, a chemical treatment prevents the formation of the interfiber bonds. For example, some chemical agent is used to prevent the pond formation. In the alternative, synthetic fibers are used to reduce affinity for bond formation. Unfortunately, all of these past attempts failed to substantially improve the trade-offs and resulted in the accompanying loss of strength in the web.

Further attempts were made to reinforce the weakened paper structure that had lost strength after the above-discussed treatments. The web structure can be strengthened by applying bonding materials to the web surface. However, since the bonding material generally reduces the interstitial space, the bonding application also reduces absorbency in the web structure. In order to maintain the absorbency characteristic, as disclosed in U.S. Pat. Nos. 4,158,594 and 3,879,257 (hereinafter the '257 patent), the bonding material may be advantageously applied in a spaced-apart pattern, and the applied area is followed by fine creping for promoting softness. Although these improvements are useful for light paper products such as tissue and towel, it is less suitable for heavier paper products which require higher abrasion resistance and strength.

One of the commonly used techniques to solve the above problem is to laminate two or more conventional webs with adhesive as disclosed in U.S. Pat. Nos. 3,414,459 and 3,556,907. Although the laminated multi-ply paper products have the desirable bulk, absorbency and abrasion-resistance for heavy wipe-dry applications, the multi-ply products require complex manufacturing processes.

In the alternative, to increase abrasion resistance and strength without sacrificing other desirable properties and complicating the manufacturing process, the '257 patent discloses the bonding material applied to a web in a spaced-apart pattern. The web structure used in the '257 patent includes only short fibers and a combination of short fibers and long fibers and forms a single laminar-like structure with internal cavities. Some short fibers are randomly oriented in the cavities to bridge outer layers so as to enhance abrasion resistance. At the same time, the remaining space in the cavity provides high absorbance. Although the '257 patent anticipated heavy uses, industrial applications require durable and highly absorbent paper products. The 257 used long fibers for enhancing only strength of the web structure. However, such heavy duty paper products necessitate the web structure with a higher total water absorption ("TWA") and a higher abrasion resistance while retaining bulk and other desirable properties.

In summary, as discussed above, there remains a number of problems for towel products. The prior attempts have either trade-offs among the desirable properties or require a complex process. Thus, the current invention is to further improve the overall desirable properties of tissues and towels without sacrificing any desirable property without the use of the multi-ply structure. It is designed to provide a product of higher total water capacity, softness and bulk than can be obtained with practice of the '257 patent.

SUMMARY OF THE INVENTION

To accomplish the above and other objectives, the current invention discloses a web structure which includes first fibers oriented substantially in a predetermined Z direction across a thickness of the web structure, the first fibers having a weight ranging from approximately 5% to approximately 30% of the total web structure; and second fibers being shorter than the first fibers and having a weight ranging from approximately 70% to approximately 95% of a total weight of the web structure, a portion of the second fibers being in contact with the first fibers and caused to be oriented substantially in the predetermined Z direction by the first fibers, thereby creating a substantially non-laminar-like structure.

According to a second aspect of the current invention, a cloth-like double-recreped web structure is provided to include pulp fibers containing low-bonding wet stiff short fibers and having a weight ranging from approximately 70% to approximately 95% of a total weight of the cloth-like web structure, the low-bonding wet stiff short fibers being substantially oriented in a predetermined Z direction; and long fibers having a length ranging from approximately 5 mm to approximately 10 mm and having a weight ranging from approximately 5% to approximately 30% of the total cloth-like web structure, the long fibers being oriented substantially in the predetermined Z direction, the low-bonding wet stiff short fibers together with the long fibers thereby increasing a Z direction peal strength of the cloth-like double-creped web.

According to a third aspect of the current invention, a cloth-like double-recreped web structure is provided to include outer regions containing wood pulp fibers having a length ranging from approximately 1 mm to 3 mm and having a weight ranging from approximately 70% to approximately 95% of a total weight of the cloth-like web structure; and an inner region located between the outer regions, the inner layer containing chemi-thermomechanical soft wood pulp (CTMP) fibers having a length ranging from approximately 1 mm to 3 mm and long fibers having a length of approximately 5 mm to approximately 10 mm, the long fibers having a weight ranging from approximately 5% to approximately 30% of the total cloth-like web structure, the long fibers and the CTMP fibers being oriented substantially in the Z direction primarily in the inner region for bridging the outer regions and providing a non-laminar web structure thereby increasing a Z direction peal strength of the cloth-like double-creped web.

According to the fourth aspect of the current invention, a method is provided to form a web structure for paper material including the following steps of a) providing a pulp layer containing first fibers of a first predetermined length and second fibers of a second predetermined length, the first predetermined length being substantially longer than the second predetermined length, the first fibers having a weight ranging from approximately 70% to approximately 95% of a total weight of the web structure, the second fibers having a weight ranging from approximately 5% to approximately 30% of the total web structure; and b) substantially orienting the first fibers and at least a portion of the second fibers in a predetermined Z orientation with respect to the pulp layer.

According to the fifth aspect of the current invention, a method is provided to form a stratified web structure for paper material, including the following steps of: a) providing an inner stratum containing first fibers of a first predetermined length and second fibers of a second predetermined length, the second predetermined length being substantially longer than the first predetermined length; b) sandwiching the inner stratum by placing at least two outer strata containing third fibers of the first predetermined length, the outer strata providing a first outer surface and a second outer surface; c) creping the web structure from the first outer surface; and d) recreping the web structure from the second outer surface, whereby the steps c and d perform a function of positioning the first fibers and the second fibers substantially in a Z direction.

According to the sixth aspect of the current invention, a method is provided to form a homogeneous web structure for paper material, including the steps of: a) providing a pulp layer containing first fibers of a first predetermined length and second fibers of a second predetermined length, the first predetermined length being substantially longer than the second predetermined length, the pulp layer providing a first outer surface and a second outer surface; b) creping the web structure on a dryer surface from the first outer surface under a positive blowing high temperature hood where an air temperature is substantially higher than the dryer surface temperature; and c) creping the web structure from the second outer surface under the positive blowing high temperature hood, whereby the steps b and c perform a function of positioning the first fibers and at least a portion of the second fibers substantially in a Z direction.

According to the seventh aspect of the current invention, an apparatus is provided to form a cloth-like creped web structure having outer layers containing wood pulp fibers having a length ranging from approximately 1 mm to 3 mm and having a weight ranging from approximately 70% to approximately 95% of the total weight of the cloth-like web structure and an inner layer located between the outer layers containing low-bonding wet stiff fibers having a length ranging from approximately 1 mm to 3 mm and long fibers having a length of approximately 5 mm to approximately 10 mm, the long fibers having a weight ranging from approximately 5% to approximately 30% of the total cloth-like web structure. The apparatus includes a bonding material applicator located near the web structure for applying a bonding material to a surface of the web structure; a drum located near the bonding applicator for providing a surface for removably placing the web structure after applying the bonding material; a transporter located adjacent to the drum and the bonding material applicator for transporting the web structure from the bonding material applicator to the drum; a doctor blade located adjacent to the drum for creping the web structure for orienting the long fibers substantially in a predetermined Z direction for bridging the outer layers, the low-bonding wet stiff fibers being positioned substantially in the predetermined Z direction primarily in the inner layer; and a positive blowing high-temperature, hood capable of creating a major temperature differential between top and bottom (creping dryer side) of the web structure located near the doctor blade for substantially enhancing an effect of placing the long fibers and the low-bonding wet stiff fibers in the predetermined Z direction thereby increasing a Z directional peal strength of the web structure.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

U.S. Pat. No. 3,879,257 (hereinafter the '257 patent) issued to Gentile et al. is hereby incorporated by reference into this application.

The fibrous web structure in accordance with the current invention preferably includes both short fibers and long fibers in a predetermined range of ratios. Preferably, the short fibers range from approximately 70% to approximately 95% of the total weight of the web structure, while the long fibers range from approximately 5% to approximately 30% of the total weight of the web structure. The short fibers generally include Northern Soft Wood Kraft (NSWK) and or soft wood chemi-thermo-mechanical pulp (CTMP). Both NSWK and CTMP are less than 3 mm in length. CTMP has a wet stiff property for stabilizing the web structure when the web structure holds liquid. The long fibers, on the other hand, generally can be natural redwood (RW), cedar, and/or other natural fibers 73 mm in length, or synthetic fibers. Some examples of the synthetic fibers include polyester (PE), rayon and acrylic fibers, and they come in a variety of predetermined widths. Each of these long fibers is generally from approximately 5 mm to approximately 9 mm in length. One example of a machine for preparing the web and an associated process is substantially similar to that disclosed in FIG. 1 of the '257 patent. However, other preparation techniques or papermaking machines may be used to form the web structure from the above-described compositions. One preferred embodiment of the web according to the current invention includes NSWK, CTMP and PE fibers and has a basis weight which ranges from approximately 22 lbs/ream to 55 lbs/ream depending upon the compositions and a preparation process. These fibers may be stratified into layers or mixed in a homogeneous single layer. When the web is stratified, in general, the short natural fibers are disposed in outer layers while the long fibers and the CTMP fibers are disposed in a middle layer. In the homogeneous web structure, all of these fibers are homogeneously present across the width of the structure. In either layer structure, since the CTMP and the synthetic fibers have low bonding properties, they do not tend to create tight bonding in the web structure. Thus, these fibers serve as a partial debonder, and, as a result, the web containing these fibers has a high degree of softness. In addition, the CTMP fibers do not become flexible when they are wetted. This wet-stiff characteristic of the CTMP fibers also serves as a reinforcer to sustain a high total water absorbance (TWA) in the web structure. For the above reasons the web containing the long fibers and the CTMP fibers has a high TWA value without sacrificing softness. As will be described later, the orientation of these fibers further substantially enhances these desirable properties of the web structure.

Figure 1:
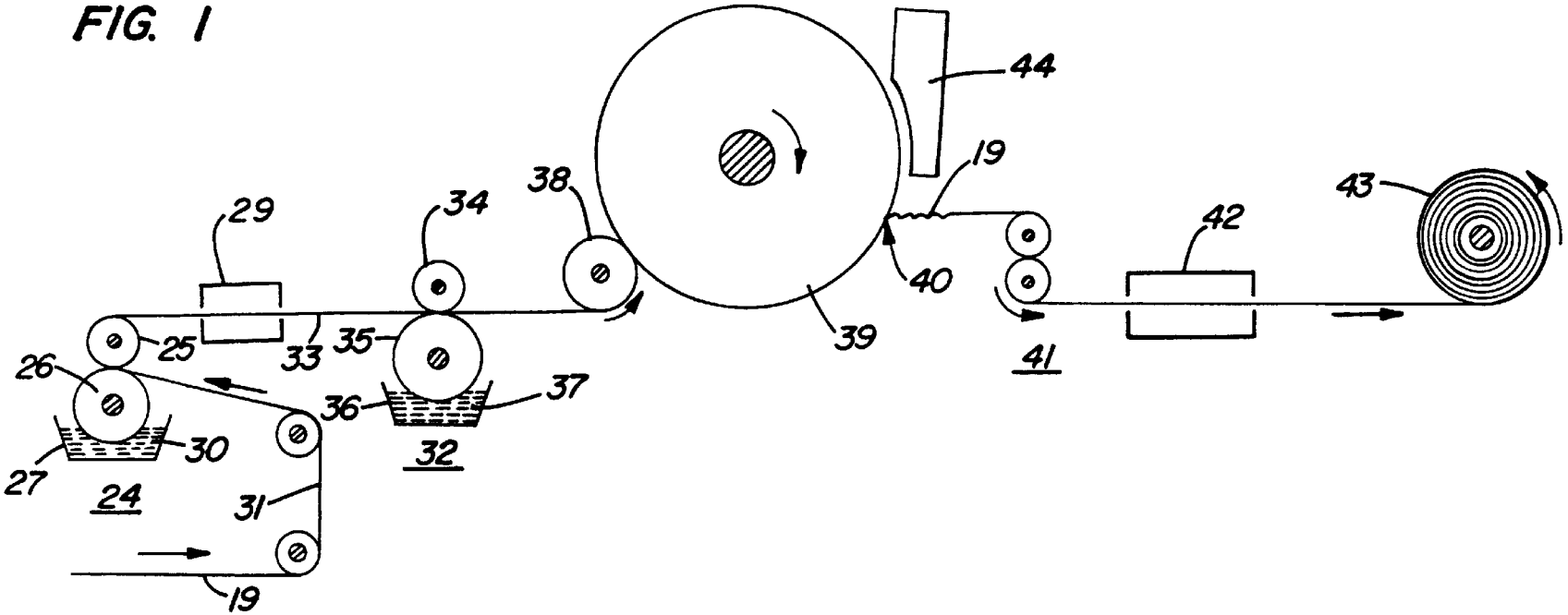
FIG. 1 illustrates one embodiment of creping apparatus according to the current invention.

The above-prepared web is then treated in accordance with a method of the current invention for further enhancing the desired properties for heavy wiper towel paper products. Referring now to the drawings, wherein like reference numerals designate the corresponding structure throughout the views, and referring in particular to FIG. 1 which illustrates one form of apparatus to practice the current invention. The embodiment of the papermaking machine as shown in FIG. 1 is generally identical to those disclosed in the '257 patent except for a high temperature, positive airflow hood 44 placed near a doctor blade 40. The hood is operated at a substantially higher temperature than the dryer drum, so as to create a temperature differential between the top and bottom of the sheet. However, this papermaking machine is only illustrative and other variations exist within the spirit of the current invention. Also claimed is the formation of the paper web on a through-dried machine, where the paper is not creped prior to the subsequent print-bonding and creping steps.

Still referring to FIG. 1, the above-described web 19 is fed into a first bonding-material application station 24 of the papermaking machine. The first bonding-material application station 24 includes a pair of opposing rollers 25, 26. The web is threaded between the smooth rubber press roll 25 and the patterned metal rotogravure roll 26, whose lower transverse portion is disposed in a first bonding material 30 in a holding pan 27. The first bonding material 30 is applied to a first surface 31 of the web 19 in a predetermined geometric pattern as the metal rotogravure roll 26 rotates. The above-applied first bonding material 30 is preferably limited to a small area of the total first surface area so that a substantial portion of the first surface area remains free from the bonding material 30. Preferably, the patterned metal rotogravure should be constructed such that only about 15% to 60% of the total first surface area of the web 19 receives the bonding material, and approximately 40% to 85% of the total first surface area remains free from the first bonding material 30.

Figure 2:
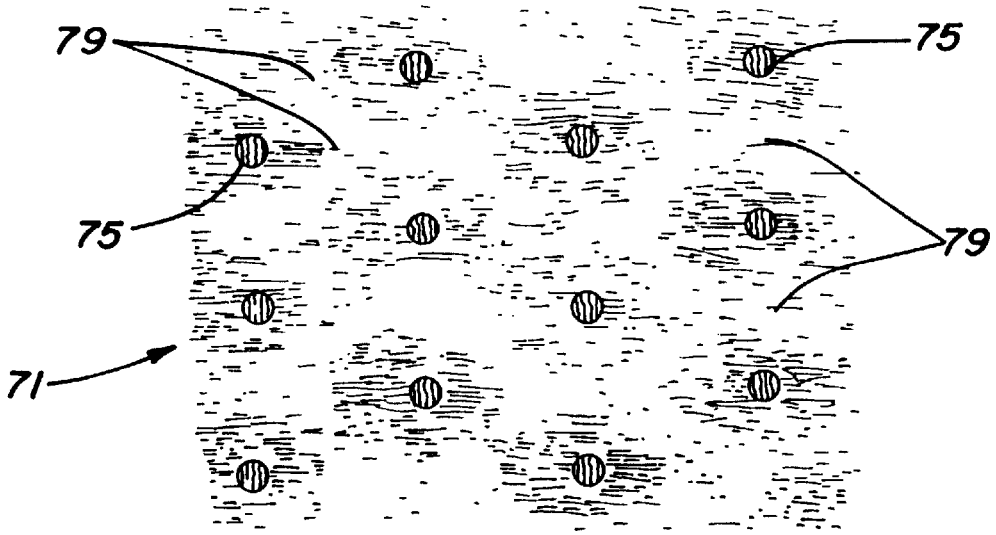
FIG. 2 illustrates a unconnected dot pattern of the bonding material applied on the web structure.
Figure 3:
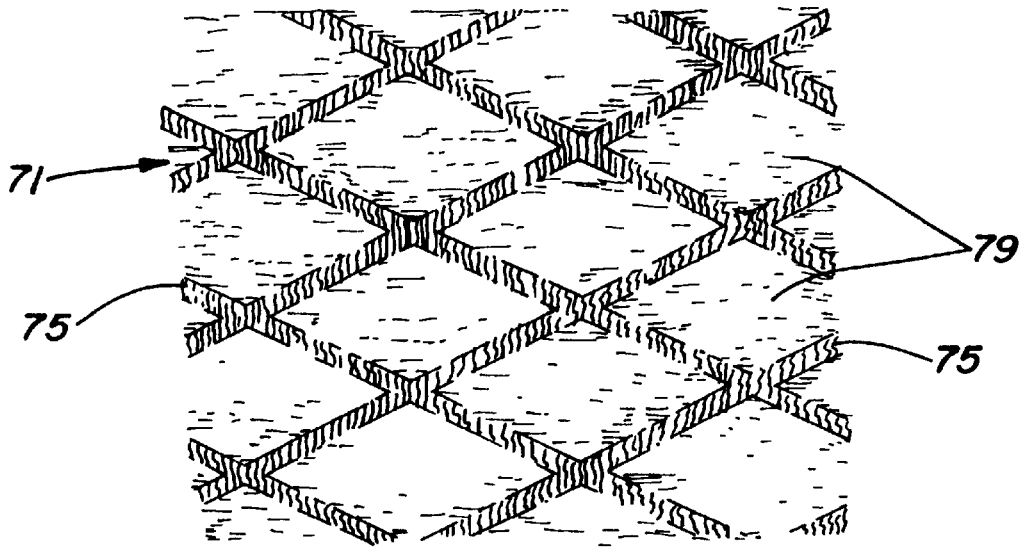
FIG. 3 illustrates a connected mesh pattern of the bonding material applied on the web structure.

The bonding material (such as vinyl acetate or acrylate homopolymer or copolymer cross-linking latex rubber emulsions) is applied to the web structure in the following predetermined manner. Preferred embodiments in accordance with the current invention include the bonding material applied either in an unconnected discrete area pattern as shown in FIG. 2 or a connected mesh pattern as shown in FIG. 3. This process is also referred to as printing. The discrete areas may be unconnected dots or parallel lines. If the bonding material is applied to the discrete unconnected areas, these areas should be spaced apart by distances less than the average fiber length according to the current invention. On the other hand, the mesh pattern application need not be spaced apart in the above limitation. Another limitation is related to penetration of the bonding material into the web structure. Preferably, the bonding material does not penetrate all the way across the thickness of the web structure even if the bonding material is applied to both top and bottom surfaces. The degree of penetration should be more than 10 percent but less than 60 percent of the thickness of the web structure. Preferably, the total weight of the applied bonding material 30 ranges from about 3% to about 20% of the total dry web weight. The degree of penetration of the bonding material is affected at least by the basis weight of the web, the pressure applied to the web during application of the bonding material and the amount of time between application of the bonding material as well known to one of ordinary skill in the art.

The bonding material for the current invention generally has at least two critical functions. First, the bonding material interconnects the fibers in the web structure. The interconnected fibers provide additional strength to the web structure. However, the bonding material hardens the web and increases the undesirable coarse tactile sensation. For this reason, the above-described limited application minimizes the trade-off and optimizes the overall quality of the paper product. In addition to interconnecting the fibers, the bonding material, located on the surface, adheres to a creping drum and the web undergoes creping, as will be more fully described below. To satisfy these functions, preferably, the butadiene acrylonitrile type, other natural or synthetic rubber lattices, or dispersions thereof with elastomeric properties such as butadiene-styrene, neoprene, polyvinyl chloride, vinyl copolymers, nylon or vinyl ethylene terpolymer may be used according to the current invention.

Referring to FIG. 1, the web 19 with the one side coated with the bonding material optionally undergoes a drying station 29 for drying the bonding material 30. The dryer 29 consists of a heat source well known to the papermaking art. The web 19 is dried before it reaches the second bonding material application station 32 so that the bonding material already on the web is prevented from sticking to a press roller 34. Upon reaching the second bonding material application station 32, a rotogravure roller 35 applies the bonding material to the other side of the web 19. The bonding material 37 is applied to the web 19 in substantially the same manner as the first application of the bonding material. A pattern of the second application may or may not be the same as the first application. Furthermore, even if the same pattern is used for the second application, the patterns do not have to be in register between the two sides.

The web 19 now undergoes creping. The web structure 19 is transported to a crepiqg drum surface 39 by a press roll 38. The bonding material applied by the second bonding material application station 32 adheres to the creping drum surface so that the web structure 19 removably stays on the creping drum 39 as the drum 39 rotates towards a doctor blade 40. One embodiment of the creping drum 39 is a pressure vessel such as a Yankee dryer heated at approximately between 180° F. and 200° F. As the web structure 19 reaches the doctor blade 40, a pair of pull-rolls 41 pulls the web structure away from the doctor blade 40. As the web structure is pulled against the doctor blade 40, the web structure is creped as known to one of ordinary skill in the art. Optionally, the creped web structure may be further dried or cured by a curing or drying station 42 before rolled on a parent roll 43.

Creping improves certain properties of the web structure. Due to the inertia in the moving web structure 19 on the rotating creping drum 39 and the force exerted by the pull-rolls 41, the stationary doctor blade 40 causes portions of the web 19 which adhere to the creping drum surface to have a series of fine fold lines. At the same time, the creping action causes the unbonded or lightly bonded fibers in the web to puff up and spread apart. Although the extent to which the web has the above-described creping effects depends upon some factors such as the bonding material, the dryer temperature, the creping speed and so on, the above-described creping generally imparts excellent softness, reduced fiber-to-fiber hydrogen bonding, and bulk characteristics in the web structure.

The above-described creping operation may be repeated so that both sides of the web structure is creped. Such a web structure is sometimes referred to as double creped web structure. Furthermore, at least one side of the web may be creped twice in the double recreped web structure. For example, a web structure having a side A and a side B may be treated in the following double recreping steps: a) creping the web structure on the side A, b) printing on the side A, c) creping again on the side A, d) printing on the side B, and e) creping on the side B.

According to a preferred embodiment of the current invention, an additional high-temperature hood 44 is provided adjacent to the creping drum 39 and the doctor blade 40. The temperature of the hood 44 is approximately 500° F. and primarily heats the top surface of the web structure 19 as it approaches the doctor blade 40. The top surface of the web structure 19, thus, has a substantially higher temperature than a bottom surface that directly lays on the creping drum 39. Such a temperature difference between the top surface and the bottom surface of the web structure enhances the above-described creping effect in such a way that causes the fibers to orient themselves in a vertical or Z direction across the thickness of the web structure. To achieve this fiber orientation, the high-temperature hood is helpful but not necessary to practice the current invention. The fibers oriented in the Z direction will be described in detail below.

Figure 4:
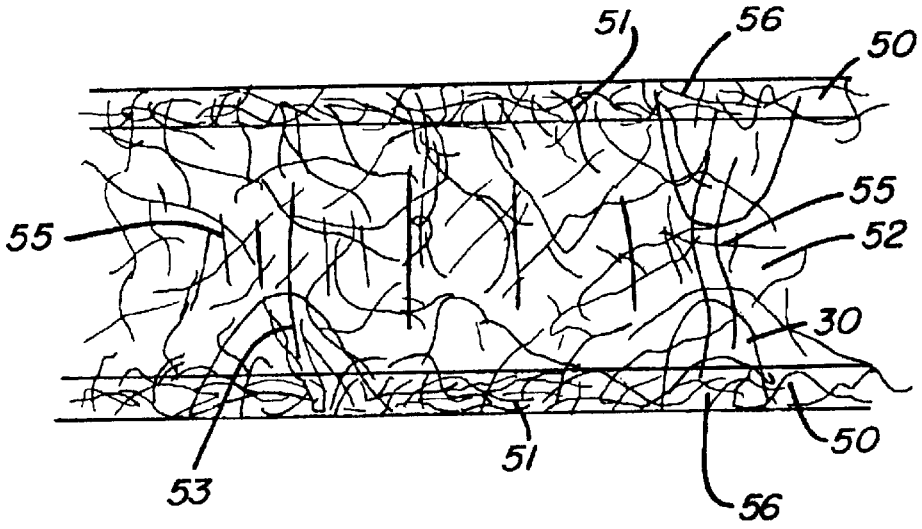
FIG. 4 illustrates a cross-sectional view of one preferred embodiment having a substantially non-laminar web structure prepared from a stratified web preparation.

Referring now to FIG. 4, a cross-sectional view of the above-described double recreped stratified web structure is diagrammatically illustrated. Outer regions 50 generally contain short fibers 51 which are oriented in random directions. A middle region is located between the two outer regions 50 and primarily contains short CTMP fibers 55 as well as a large portion of long fibers 53. These long fibers may be either synthetic or natural. Examples of long synthetic fibers include polyester and rayon while long natural fibers include Redwood Kraft and cedar pulp. These short and long fibers in the middle region are substantially oriented in a vertical or Z direction across the thickness of the web structure. As the web structure is creped, the middle region fibers that are relatively mobile due to their low bonding property are "popped up" or "stood up" in the Z direction, partially due to their entanglement with other long fibers that are anchored by the printed latex bonding agent.

As a result, some Z orientedalong fibers 53 extend between the two outer regions 50 and serve as structural reinforcers. The structural reinforcement is more effective in areas 56 where a bonding material is applied. The bonding material 30 is penetrated through the outer region 50 into a portion of the middle region 52 (up to SO'), interconnecting ends of the Z oriented long fibers 53 and thereby more effectively reinforcing the web structure. Such structural reinforcement increases abrasion resistance or Z-peel resistance. Z-peel is measured by placing a tape on both sides of a 1"×6" piece of the web structure and peeling one side in a direction 180 degrees to the opposite side using an automated tensile tester. The increased structural reinforcement is also confirmed by other conventional measurements such as cured cross direction wet tensile (CCDWT), machine direction tensile (MDT), machine direction strength (MDS) and cross directional strength (CDS).

Figure 5A:
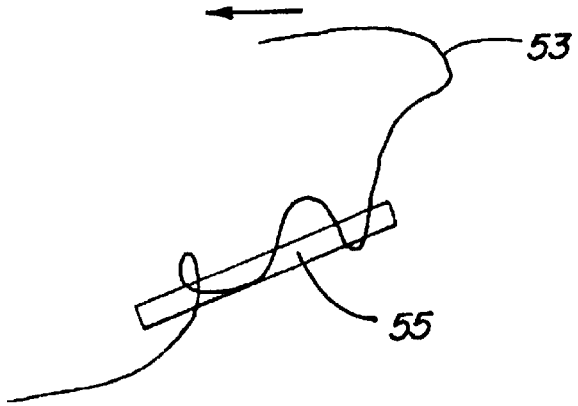
FIG. 5 illustrate a sequence of movement of long fibers in relation to short fibers while they are substantially oriented in the predetermined Z direction.
Figure 5B:
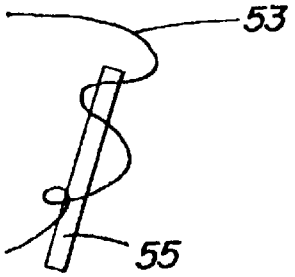

As the long fibers are pulled into the Z direction across the thickness of the web structure during the creping operation, the long fibers cause other fibers to orient in the same direction. Referring to FIG. 5(*a*), a long fiber 53 is located in a random orientation before creping. A short CTMP fiber 55 is located adjacent to the long fiber 53, and a portion of the long fiber 53 is entangled with the CTMP fiber 55 as shown in FIG. 5(*a*). As the long fiber 53 is pulled during creping as indicated by an arrow, the entangled portion of the CTMP fiber 55 is also pulled in the same direction. As a result, the CTMP fiber 55 is oriented substantially in the predetermined Z direction as shown in FIG. 5(*b*). The mobility of these long synthetic fibers and the CTMP fibers in the interstitial space is also due to their low-bonding property for not strongly bonding to other fibers. Furthermore, the long fibers 53 such as polyester fibers are available in different widths including ¼ denier. In general, thinner fibers have more mobility in the interstitial space. Based upon the above reasons, these long fibers and CTMP fibers are generally more responsive to creping operations in orienting themselves in the Z direction.

Because of the Z orientation of the fibers in the middle region, the web structure according to the current invention appears substantially non-laminar. Unlike a laminar-like web structure of the '257 patent, no substantial cavity or cavern exists in the current web structure. In other words, the fibers are more uniformly distributed as well as oriented across the thickness of the web structure so as to reduce the lamination of the web structure. In particular, the wet stiff CTMP fibers in the middle region provide structural bone to prevent water from causing further collapse in the web structure. The CTMP fibers reinforce the recreped structure while it provides greater bulk to basis weight for a larger water holding capacity or TWA without a danger of collapse.

High TWA is also a result of the bonding material applied in the above-described pattern. Generally, water absorption rate is hindered by the water resistant bonding material coated on the web surface. To increase the water absorption rate, the bonding material according to the current invention is applied to less than 60% of the surface area, leaving a significant intact surface area where water freely passes into the web structure. Furthermore, in preferred embodiments, the above limited bonding material is applied in an unconnected dot pattern or a connected mesh pattern.

The above-described high TWA characteristic of the non-collapsible web structure of the current invention does not sacrifice a softness characteristic. Generally, as described above, softness is sacrificed as a trade-off when the web structure is strengthened for higher TWA. However, according to the current invention, the hard bonding material is applied to a limited area of surface area, and a large portion of the web surface is not affected by the hard bonding material. The bonding material is also applied to penetrate only a portion of the thickness. In addition, the coarse CTMP fibers are generally located in the middle region of the web structure so that roughness is not directly felt on the web surface. Lastly, as already described, the surface area is softened by creping. Based upon these reasons, softness of the web structure is not sacrificed in the high TWA web structure of the current invention.

Figure 6:
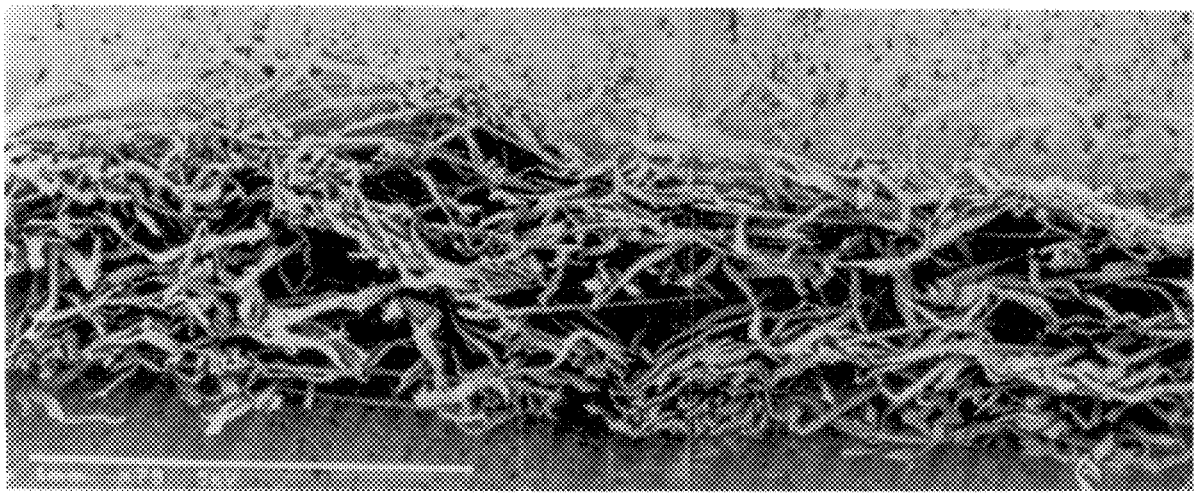
FIG. 6 illustrates a cross-sectional view of another preferred embodiment having a substantially non-laminar web structure prepared from a homogeneous web preparation.

FIG. 6 illustrates a cross-sectional view of a non-laminar web structure manufactured from a homogeneous preparation according to the current invention. Similar to the above-described stratified web preparation, a homogeneous web preparation includes the above-described combination of both short fibers and long fibers. However, since the homogenous preparation has a uniform distribution of the short and long fibers, the concentration of the CTMP fibers in the desirable middle region in the creped homogeneous web structure is generally lower than that in the comparable stratified web structure. Thus, an alternative embodiment using a homogenous web preparation may optionally consist of a higher CTMP fiber concentration. Despite the above difference, the web structure prepared from the homogenous preparation according to the current invention exhibits improvements to the web structure prepared from the stratified preparation.

According to another preferred embodiment, a through-dried web structure is used in combination with the above-described double recreping operation. Instead of using a wet-pressed, Yankee-creped web structure, the web structure is first substantially through dried and then the through-dried web structure having a side A and a side B may be treated in the above-described double recreping steps a) through e).

The through-dried double recreped web structure has a commercial advantage. Although total water absorbency (TWA) of the through-dried web structure is not necessarily higher than that of the wet-pressed, Yankee-creped, double recreped web structure, the through-dried double recreped web structure has a substantially superior quality in softness, uniformity as well as strength. In addition, the through-dried double recreped web structure improves efficiency in manufacturing paper products.

The specific differences in characteristics among different compositions of the web structure will be described below in reference to examples.

EXAMPLES

In the following, specific examples of the web structure prepared from stratified and homogeneous preparations are given to further illustrate embodiments of the current invention, but they should not be taken as limiting the invention beyond that which is described in the specification and the claims. These examples are compared to a control which has the following characteristics:

Stratified Control: The stratified control web structure consists of 100% NSWK and is double recreped.

Basis Weight (BW): 32.7
Balk/Basis Weight (Blk/BW): 15.5
Cured Cross Direction Wet Tensile (CCDWT): 5.3
Machine Direction Tensile (MDT): 10.3
Machine Direction Strength (MDS): 27
Cross Directional Tensile (CDT): 9.4
Cross Directional Strength (CDS): 15
Total Water Absorption (TWA)gm/gm: 7.4
Z peel gm/in: 8.7
(12% increase in TWA at 73% increase in peel)

Example 1

A wet creped stratified preparation consisted of 45% RW and 55% NWSK had the following characteristics:

Basis Weight (BW): 26.8
Balk/Basis Weight (Blk/BW): 18.5
Cured Cross Direction Wet Tensile (CCDWT): 5.0
Machine Direction Tensile (MDT): 13.8
Machine Direction Strength (MDS): 29
Cross Directional Tensile (CDT): 7.8
Cross Directional Strength (CDS): 23
Total Water Absorption (TWA)gm/gm: 8.3
Z peel gm/in: 15.1

Example 1 shows that the long fibers in the web structure improved both Z peel and TWA over the control as well as other properties. Although the Z peel value increased nearly doubled, the TWA value increased by approximately 10%.

Example 2

A wet creped stratified preparation consisted of 20% CTMP, 28% RW, 52% NWSK had the following characteristics:

Basis Weight (BW): 26.4
Balk/Basis Weight (Blk/BW): 19.9
Cured Cross Direction Wet Tensile (CCDWT): 5.3
Machine Direction Tensile (MDT): 17.4
Machine Direction Strength (MDS): 24
Cross Directional Tensile (CDT): 8.1
Cross Directional Strength (CDS): 32
Total Water Absorption (TWA)gm/gm: 8.8
Z peel gm/in: 10.2
(19% increase in TWA at 17% increase in peel)

Example 2 exhibited that both TWA and Z peel increased by approximately 20%.

Example 3

A wet creped stratified preparation consisted of 3.5% PE (1.5 denier), 43% RW and 51.5% NWSK had the following characteristics:

Basis Weight (BW): 27.2
Balk/Basis Weight (Blk/BW): 19.6
Cured Cross Direction Wet Tensile (CCDWT): 5.8

Machine Direction Tensile (MDT): 16.6

Machine Direction Strength (MDS): 30

Cross Directional Tensile (CDT): 8.1

Cross Directional Strength (CDS): 30

Total Water Absorption (TWA)gm/gm: 9.1

Z peel gm/in: 17.6

(23% increase in TWA at 101% increase in peel)

Example 3 exhibited over 25% TWA increase accompanied by over 200% Z peel increase. In addition, except for BW and CDT, all other measured properties have been improved.

Example 4

A wet creped stratified preparation consisted of 15% PE (3 denier) and 85% NWSK had the following characteristics:

Basis Weight (BW): 28.9

Balk/Basis Weight (Blk/BW): 18.8

Cured Cross Direction Wet Tensile (CCDWT): 5.2

Machine Direction Tensile (MDT): 15

Machine Direction Stretch (MDS): 23

Cross Directional Tensile (CDT): 9

Cross Directional Stretch (CDS): 20

Total Water Absorption (TWA)gm/gm: 8.5

Z peel gm/in: –

Example 4 exhibited at least approximately 15% TWA increase. The Z peel value was not obtained for this example.

Example 5

A wet creped stratified preparation consisted of 48% RW, 48% NWSK and 4% PE (0.4 denier) had the following characteristics:

Basis Weight (BW): 27.6

Balk/Basis Weight (Blk/BW): 19.0

Cured Cross Direction Wet Tensile (CCDWT): 5.7

Machine Direction Tensile (MDT): 20.5

Machine Direction Strength (MDS): 26.7

Cross Directional Tensile (CDT): 7.1

Cross Directional Strength (CDS): 27

Total Water Absorption (TWA)gm/gm: 10.0

Z peel gm/in: 14.7

(35% increase in TWA at a 69% increase in peel)

Example 5 exhibited both approximately 45% TWA increase as well as approximately 15% Z peel increase.

Example 6

A wet creped homogeneous preparation consisted of 60% RW and 40% NWSK had the following characteristics:

Basis Weight (BW): 26.5

Balk/Basis Weight (Blk/BW): 17.7

Cured Cross Direction Wet Tensile (CCDWT): 5.4

Machine Direction Tensile (MDT): 14

Machine Direction Strength (MDS): 18

Cross Directional Tensile (CDT): 6.8

Cross Directional Strength (CDS): 24

Total Water Absorption (TWA)gm/gm: 8.6

Z peel gm/in: 11.3

Example 6 exhibited at least approximately 15% TWA increase. The Z peel value was decreased by about 10% in this example.

Example 7

Through-dried, DRC towel was developed to compare a through-dried, no press, no crepe base sheet that has been double-recreped with a standard wetpress, creped base sheet. The parer was made on the 24" PM and converted to double-recreped product on the Apt.#8 pilot unit, which does not have the bulk enhancing Hightemperature hood.

Basis Weight (BW) (lbs/rm): 31.0

Balk/Basis Weight (Blk/BW): 17.4

Cured CD Wet Tensile (CCDWT) (oz/in): 6.1

Machine Directional Tensile (MDT): 27

Machine Direction Stretch (MDS): 28.5

Cross Directional Tensile (CDT): 14.8

Cross Directional Stretch (CDS): 20

Total Water Absorption (TWA)gm/gm: 10.4

Z peel gm/in: 15.4

(a 40% increase in TWA with a 74% increase in peel)

Example 7 is 15% stratified Polyester (middle layer, 1.5 denier, with the balance being NSWK). This is thought to be the best embodiment, with further enhancements possible using the high-temperature hoods and combinations with CTMP furnish.

Homogeneous Control: The homogeneous control wet web structure consists of 100% NSWK and is double recreped.

Basis Weight (BW): 28

Balk/Basis Weight (Blk/BW): 16.6

Cured Cross Direction Wet Tensile (CCDWT): 5.4

Machine Direction Tensile (MDT): 19

Machine Direction Strength (MDS): 19

Cross Directional Tensile (CDT): 8.4

Cross Directional Strength (CDS): 16

Total Water Absorption (TWA)gm/gm: 6.7

Z peel gm/in: 12.6

(27% increase in TWA at a 10% loss in peel)

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A double-recreped web structure comprising:

short fibers containing chemi-thermomechanical pulp (CTMP) fibers and having a weight ranging from approximately 70% to approximately 95% of the total weight of the web structure, said CTMP fibers being substantially oriented in the Z direction of the web structure; and long fibers having a length ranging from approximately 5 mm to approximately 10 mm and having a weight ranging from approximately 5% to approximately 30% of the total weight of the web structure, said long fibers being oriented substantially in the Z direction of the web structure, said CTMP fibers together with said long fibers thereby increasing the Z direction peel strength of the web structure.

2. The double-recreped web structure according to claim 1, wherein said short fibers and said long fibers are stratified respectively into two outer layers and a middle layer, said long fibers being positioned substantially in said middle layer.

3. The double-recreped web structure according to claim 1, wherein said short fibers and said long fibers are homogeneously mixed.

4. The double-recreped web structure according to claim 1 having a basis weight in the range of 20 to 50 lbs/ream.

5. The double-recreped web structure according to claim 1 having a total water absorption of from about 8.3 to about 10.4 gm/gm.

6. The double-recreped web structure according to claim 1 having a Z direction peel strength of from about 10.2 to about 17.6 gm/in.

7. A double-recreped web structure comprising:

outer regions containing wood pulp fibers having a length ranging from approximately 1 mm to 3 mm and having a weight ranging from approximately 70% to approximately 95% of the total weight of the web structure; and an inner region located between said outer regions, said inner region containing chemi-thermomechanical softwood pulp (CTMP) fibers having a length ranging from approximately 1 mm to 3 mm and long fibers having a length of approximately 5 mm to approximately 10 mm, said long fibers having a weight ranging from approximately 5% to approximately 30% of the web structure, said long fibers and said CTMP fibers being oriented substantially in the Z direction primarily in said inner region for bridging said outer regions and providing a non-laminar web structure thereby increasing the Z direction peel strength of the web structure.

8. The web structure of claim 7 having a Z direction peel strength of from about 10.2 to about 17.6 gm/in.

9. The web structure of claim 7 having a total water absorption of from about 8.3 to about 10.4 gm/gm.

* * * * *